United States Patent [19]

Black

[11] Patent Number: 4,461,214

[45] Date of Patent: Jul. 24, 1984

[54] CARTRIDGE LOADED HYBRID PROPELLANT

[75] Inventor: William L. Black, Ridgecrest, Calif.

[73] Assignee: The United States of America as represented by the Secretary of the Navy, Washington, D.C.

[21] Appl. No.: 391,263

[22] Filed: Jun. 24, 1982

[51] Int. Cl.[3] ..... F42B 5/02

[52] U.S. Cl. ..... 102/440; 102/443

[58] Field of Search ..... 102/430, 440, 443, 374, 102/376; 149/74, 20

[56] References Cited

U.S. PATENT DOCUMENTS

| | | | |
|---|---|---|---|
| 2,960,031 | 11/1960 | Cliff | 102/40 |
| 3,749,615 | 7/1973 | Dorsey, Jr. et al. | 102/430 |
| 3,933,542 | 1/1976 | Childs, Jr. et al. | 149/20 |

FOREIGN PATENT DOCUMENTS

| | | | |
|---|---|---|---|
| 721289 | 6/1942 | Fed. Rep. of Germany | 102/443 |
| 2622156 | 11/1977 | Fed. Rep. of Germany | 102/440 |

*Primary Examiner*—Harold J. Tudor

*Attorney, Agent, or Firm*—Robert F. Beers; W. Thom Skeer

[57] ABSTRACT

A round of ammunition uses both a solid propellant and an oxygen-rich, liquid monopropellant. The liquid propellant is held within a plastic container within the conventional case.

1 Claim, 2 Drawing Figures

CARTRIDGE LOADED HYBRID PROPELLANT

BACKGROUND OF THE INVENTION

1. Field of the Invention

This invention pertains to the field of ordnance. More particularly, this invention pertains to an improved round of ammunition. In still greater particularly this invention pertains to a round of fixed ammunition having improved velocity, reduced muzzle flash, more uniform pressures and cleaner operation. In still greater particularlity, this invention shall be described as it pertains to a round of hybrid propellant ammunition employing both solid and liquid monopropellant propellant compounds.

2. Description of the Prior Art

Existing guns, for the most part, employ fixed ammunition i.e. ammunition in which the propellant and the projectile are carried together in a fixed case. Such ammunition has undergone extensive development for many years and has reached a high level of perfection. Nonetheless, it is a constant goal of those engaged in the ordnance development sciences to achieve greater muzzle velocities without increases in case size.

Liquid propellant guns are also known in the art in which a propellant and an oxdizer are mixed to produce the explosive mixture. Although satisfactory for many purposes, the storage of such ammunition and its use in conventional weapons leaves many unsolved problems. For example, attempts to employ this type of ammunition have sometimes employed a small grain of solid propellant insufficient for projectile propulsion, to expel the propellant liquid and oxidizing liquid into a separate combustion chamber carried within the round of fixed ammunition. In this arrangement, a wall or other internal mechanism within the case must withstand the combustion pressures of the propellant for failure to do so results in erratic combustion and the possibility of lodging portions of the separator wall within the barrel of the firearm using the ammunition.

In other arrangements the liquid propellants and oxidizers have been carried in separate compartments within the case to be ignited by a separate ignition means.

SUMMARY OF THE INVENTION

This invention includes a round of fixed ammunition having a rigid case supporting a projectile in the neck thereof which seals the case and provides both the combustion and propellant storage areas in the conventional fashion, familiar to those accustomed to the use of solid propellants. A significant quanity of solid propellant is housed within the casing together with a container of liquid monopropellant. Solid propellants which have the characteristic of being fuel rich achieve a rapid increase in pressure (while consuming available oxidizer then) steadily diminish until maximum (down bore) pressure is seldon maintained during the internal ballistic cycle of the projectile flight. By combining a carefully chosen oxidizer rich liquid monopropellant with the solid propellant a more uniform burning pressure is achieved, more complete combustion is achieved, and the desired resulting cooler operational temperatures and complete combustion achieves improved ballistic response.

It is accordingly an object of this invention to provide an improved round of fixed ammunition.

A further object of this invention is to provide a round of fixed ammunition having more uniform combustion pressures and more complete combustion.

Still another object of this invention is to provide a round of fixed ammunition using a hybrid propellant including both solid and liquid propellants.

These and further objects of the invention will become more apparent to one skilled in the ordnance arts when considered in view of the following specification, claims, and drawings in which:

DESCRIPTION OF THE PREFERRED EMBODIMENT

Figure 1:
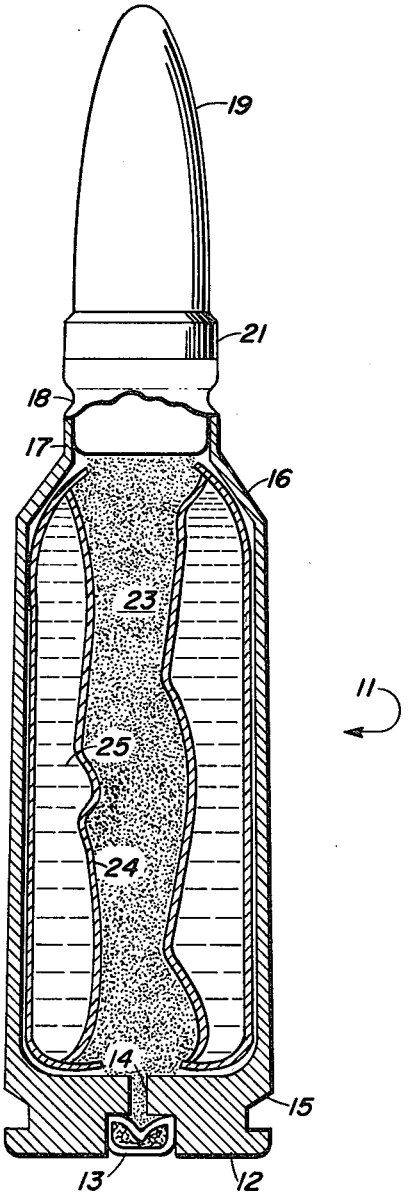
FIG. 1 is a partial cutaway view of a round of ordnance in accordance with the invention.

Referring to FIG. 1, a round of fixed ammunition according to the invention is indicated generally at 11. The round includes a cartridge case having a head 12 and an ignition primer 13 mounted therein which communicates with a flash whole bore 14. An extruder groove 15 encircles cylinder head 12 in the conventional fashion. At the forward end of projectile 11 the case has a shoulder 16 which provides conventional head spacing against a chamber wall and a neck 17, a crimping cannelure 18 which helps support projectile 19. Projectile 19 has a flat base and a soft rotation band 21. A cannelure within projectile 19 cooperates with the crimped cannelure 18 in neck 17 to rigidly mount projectile 19 within neck 17 of the round 11. The base of the projectile 19 defines the forward end of the combustion chamber and propellant storage space within the confines of the body portion of round 11.

A amount of solid propellant 23 is stored within this combustion chamber and propellant storage space and is in communication with flash hole 14 to permit ignition by primer 13. The amount of solid propellant within round 11 is sufficient to obtain complete projectile expulsion and moderate muzzle velocity. A toric shaped bag 24 is also contained within the body of round 11 and has its outer walls in close proximity to the inner walls of the shell case. A liquid monopropellant 25 is contained within bag 24 and, upon ignition of solid propellant 23, is ignited to add to the combustion propelling projectile 19 down the bore of the gun in a conventional fashion. Bag 25 is made of a plastic material which also burns in the combustion process such that no metallic cartridge parts are present to be lodged within the bore of the gun.

The propellants used in round 11 are a single base nitro cellulose solid propellant and the liquid monopropellant is hydroxylammonium nitrate $HONH_3^+NO_3^-$.

Figure 2:
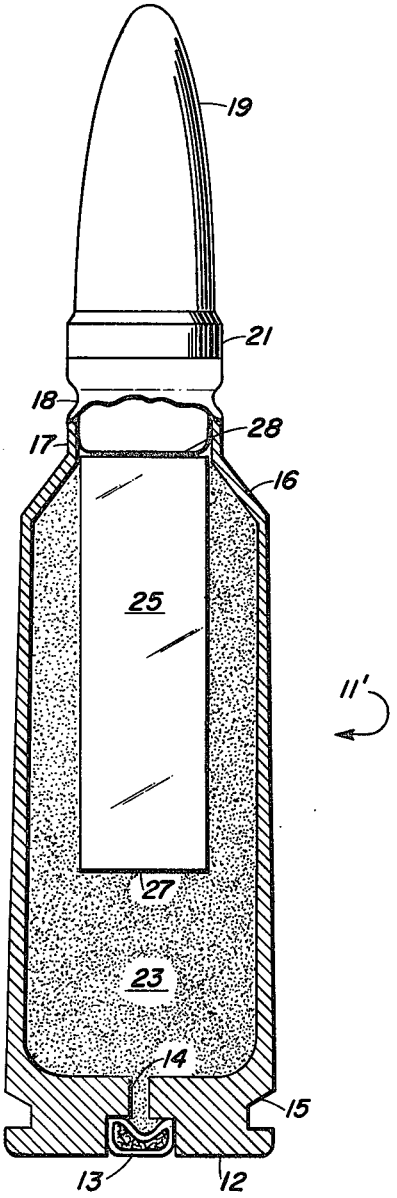
FIG. 2 is a partial cutaway view of a round of ordnance according to the invention involving a projectile carried ampule of liquid propellant.

Referring to FIG. 2, the variation in construction is illustrated in this embodiment, liquid monopropellant 25 is maintained in an ampule 27 which is also made of a frangible plastic and is held to the base of projectile 19 by a cement bond in indicated at 28. In other respects, projectile 11' functions in the same fashion as the embodiment illustrated at FIG. 1.

In operation, the ignition of the solid propellant 23 causes the temperature and pressure within the case to rise. Increase in temperature and pressure ruptures the monopropellant container, bag 24 or ampule 27, to add the liquid monopropellant to the combustion process.

The oxygen rich liquid monopropellant further aids the combustion of the solid propellant and keeps a high pressure on the gun bore until the time of projectile exit. Continuing high pressure to muzzle exit causes the projectile to exit with a higher muzzle velocity resulting in decreased time of projectile flight and increased penetration. Of course, the attendant flatter trajectory curve accompanying higher muzzle velocities is also observed.

The foregoing description taken together with the appended claims constitute a disclosure such as to enable a person skilled in the ordnance arts and having the benefit of the teachings contained therein to make and use the invention. Further, the structure herein described meets the objects of invention, and generally constitutes a meritorious advance in the art unobvious to such a person not having the benefit of these teachings.

I claim:

1. A round of ammunition comprising:

a case including a body, a neck and a case head;

ignition means mounted in said case head;

a projectile retained in said neck having a base to define a propellant storage volume within said case body in communication with said ignition means;

a frangible, toric-shaped, flexible bag positioned with the outer wall thereof in contact with the inner walls of said propellant storage volume of said case and the central void thereof in alignment with said ignition means;

a solid propellant housed within said propellant storage volume and in communication with said ignition means and substantially filling the central void of said frangible, toric-shaped, flexible bag; and a predetermined quantity of hydroxylammonium nitrate ($HONH_3^+NO_3^-$) within said frangible, toric-shaped, flexible bag, whereby ignition of said ignition means causes said solid propellant to be ignited and to rupture said bag for ignition of the contents thereof.

* * * * *